US005685655A

United States Patent [19]

Del Signore, II et al.

[11] Patent Number: 5,685,655

[45] Date of Patent: Nov. 11, 1997

[54] SECURITY SYSTEM FOR UNATTENDED PRINTING MECHANISM

[75] Inventors: James R. Del Signore, II, Trumansberg; Andrew B. Nye, III, Lansing; Hillis L. Wilson, Groton, all of N.Y.

[73] Assignee: NCR Corporation, Dayton, Ohio

[21] Appl. No.: 570,843

[22] Filed: Dec. 12, 1995

[51] Int. Cl.[6] ..... B41J 11/00

[52] U.S. Cl. ..... 400/582; 400/74; 400/583; 395/111

[58] Field of Search ..... 400/74, 582, 578, 400/279, 583, 708; 395/111

[56] References Cited

U.S. PATENT DOCUMENTS

| | | | |
|---|---|---|---|
| 3,323,700 | 6/1967 | Epstein et al. . | |
| 3,917,142 | 11/1975 | Guarderas . | |
| 3,958,735 | 5/1976 | Wanat . | |
| 4,091,913 | 5/1978 | Ku et al. . | |
| 4,216,482 | 8/1980 | Mason . | |
| 4,239,404 | 12/1980 | DeFilipps et al. . | |
| 4,370,665 | 1/1983 | Scranton et al. . | |
| 4,530,613 | 7/1985 | Horman et al. . | |
| 4,892,426 | 1/1990 | Steele . | |
| 5,118,932 | 6/1992 | Brownrigg et al. . | |
| 5,119,725 | 6/1992 | Okamura . | |
| 5,131,770 | 7/1992 | Kanemitsu . | |
| 5,228,792 | 7/1993 | Crevecoeur et al. . | |
| 5,240,368 | 8/1993 | Graef et al. | 414/788.9 |
| 5,405,069 | 4/1995 | Duncan et al. . | |
| 5,443,255 | 8/1995 | Nanba et al. | 271/273 |
| 5,548,632 | 8/1996 | Walsh et al. | 379/58 |
| 5,564,845 | 10/1996 | Yamaguchi et al. | 400/582 |
| 5,585,645 | 12/1996 | Goto | 250/559.12 |
| 5,588,762 | 12/1996 | Suzuki | 400/708 |
| 5,593,149 | 1/1997 | Kimura | 271/3.01 |

*Primary Examiner*—John S. Hilten

[57] ABSTRACT

A security system for an unattended printing mechanism, such as that found in an automatic teller machine. The security system has a programmable microprocessor which sends data to a journal printer and actuates a journal motor that controls the rotation of the paper take-up drum. A timing disk is rotationally attached to the take-up drum. A sensor mounted adjacent the timing disk senses the rotation of the timing disk and the rotation of the take-up drum. As the timing disk rotates, the sensor generates alternating high and low signals. The sensor signals are fed to the microprocessor, which assesses the number of high/low signals, and the amount of paper being fed to the take-up roll. When it does not see a proper number of high-to-low transitions for a given amount of journal motor rotation, the microprocessor provides a signal that a jam has occurred in the printing system. The microprocessor continually monitors the sensor signals. When the journal motor is not running, transition signals received by the microprocessor from the sensor indicate tampering with the take-up roll and then the monitoring center is altered.

20 Claims, 3 Drawing Sheets

SECURITY SYSTEM FOR UNATTENDED PRINTING MECHANISM

FIELD OF THE INVENTION

The invention pertains to unattended printing mechanisms, such as automatic teller machines (ATMs), and, more particularly, to a security system that senses and monitors the motion of the journal roll of an unattended printing mechanism, in order to counter attempts at tampering and to report any malfunctions or problems with its recordkeeping.

BACKGROUND OF THE INVENTION

The use of automatic teller machines (ATMs) has become widespread. This machine contains internal recordkeeping mechanisms that use a printer and a journal roll mechanism to record various transactions. Due to its unattended environment, this machine has endured many incidences of tampering. Therefore, there is a need to provide a system that will monitor the condition of the ATM and that of its journal roll, in order to ensure security and to report any malfunctions.

The present invention provides a security system for an unattended printing mechanism, such as an ATM, whereby the paper receipt on the take-up roll can be sensed and monitored in the journal-printing section of the machine. This security system provides means for alerting officials to any security breaches and/or malfunctions in the recordkeeping mechanism of the system.

The system of the invention comprises a toothed wheel that rotates with the take-up roll of the journal printer mechanism. A sensor disposed adjacent the toothed wheel generates alternately high and low signals as the wheel rotates and the teeth pass before the sensor's eye. These sensor signals are fed to a programmed microprocessor which controls and monitors the journal motor. When the journal motor is actuated and sensor signals are not forthcoming, the security system ascertains that the journal mechanism is jammed or not working properly. Conversely, tampering is indicated, when the microprocessor detects sensor signals and the motor has not been energized.

It is an object of this invention to provide an improved security system for an unattended printing mechanism.

It is another object of this invention to provide a security system for an unattended printing mechanism that compares the rotation of a take-up roll with the actuation of a journal motor, in order to assess a condition of either tampering or jamming in the printing mechanism.

DISCUSSION OF RELATED ART

In U.S. Pat. No. 3,323,700 (entitled "Web Driving System with Driving, Braking and Motion Sensing Units adjacent each Margin of the Web", and issued on Jun. 6, 1967, to EPSTEIN et al), a timing disc is shown that determines the amount of movement of a paper web.

In U.S. Pat. No. 3,917,142 (entitled "Paper Motion Sensor Apparatus", and issued on Nov. 4, 1975, to GUARDERAS), a notched wheel is illustrated that is used to indicate the motion of a paper web.

In U.S. Pat. No. 3,958,735 (entitled "Method and Apparatus for Detecting Paper Drive Malfunctioning in an Automatic Printer", and issued on May 25, 1976, to WANAT), a jam-detecting mechanism is shown in which two cams are forced into registration during a jam, which actuates a switch that provides a signal that interrupts the paper drive mechanism in response thereto.

In U.S. Pat. No. 3,949,856 (entitled "System to Detect Abnormal Paper Feed in Printers", and issued on Apr. 13, 1976, to ULBER et al), a system is illustrated in which the paper feed is monitored in conjunction with the actuation of the paper web's feeding drive, and the generation of a feed reference signal. An abnormal condition is determined when the reference feed signal does not compare favorably with the monitored feed signal. A timing disk attached to the paper feed drive is used to monitor the paper feed.

SUMMARY OF THE INVENTION

In accordance with the present invention, there is provided a security system for an unattended printing mechanism, such as that found in an automatic teller machine. This security system comprises a programmable microprocessor which sends data to a journal printer, and actuates a journal motor that controls the rotation of the paper take-up drum. A timing disk is rotationally affixed to the take-up drum. A sensor mounted adjacent the timing disk senses the rotation of the timing disk and, ergo, that of the take-up drum. As the timing disk rotates, the sensor generates alternating high and low signals. The sensor signals are fed to the microprocessor, which assesses the number of high/low signals and, hence, the amount of paper being fed to the take-up roll. When it does not see a proper number of high-to-low transitions for a given amount of journal-motor rotation, the microprocessor provides a signal that a jam has occurred in the printing system. The microprocessor continually monitors the sensor signals. When the journal motor is not running, transition signals received by the microprocessor from the sensor will indicate tampering with the take-up roll. When tampering is evident, the microprocessor then alerts the monitoring center.

BRIEF DESCRIPTION OF THE DRAWINGS

A complete understanding of the present invention may be obtained by reference to the accompanying drawings, when considered in conjunction with the subsequent detailed description, in which.

For the purposes of brevity and clarity, like elements will bear the same designations throughout the FIGURES.

DESCRIPTION OF THE PREFERRED EMBODIMENT

Generally speaking, the invention features a security system for an unattended printing mechanism, such as that found in automatic teller machines. This security system monitors the rotation of a paper-web take-up roll as a function of the paper-web drive motor. When the paper web drive motor is actuated, but no movement is sensed in the take-up roll, a jam condition is indicated by the security system. Conversely, when movement is sensed in the take-up roll and the drive motor is not actuated, a tampering condition is indicated.

Figure 1:
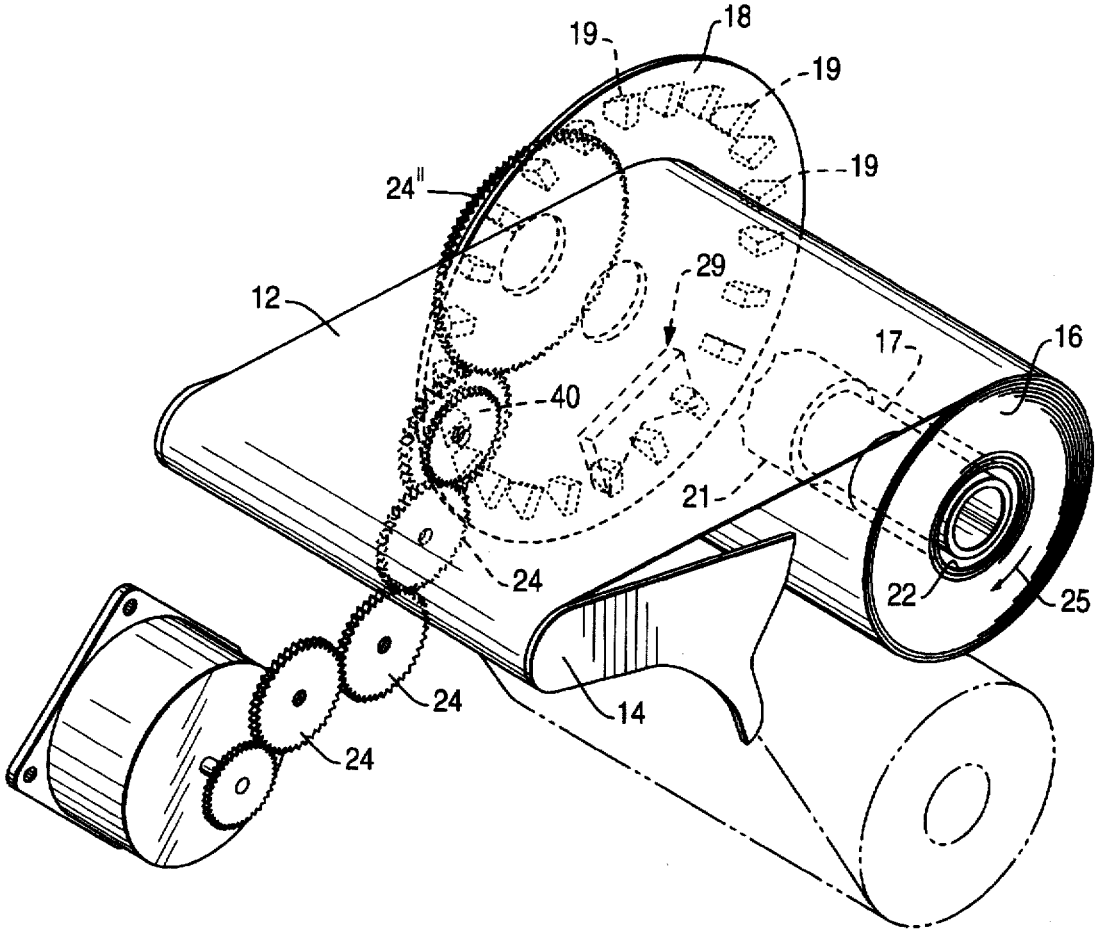
FIG. 1 illustrates a partial, perspective view of the journal-printing mechanism and security system in accordance with the invention.
Figure 2:
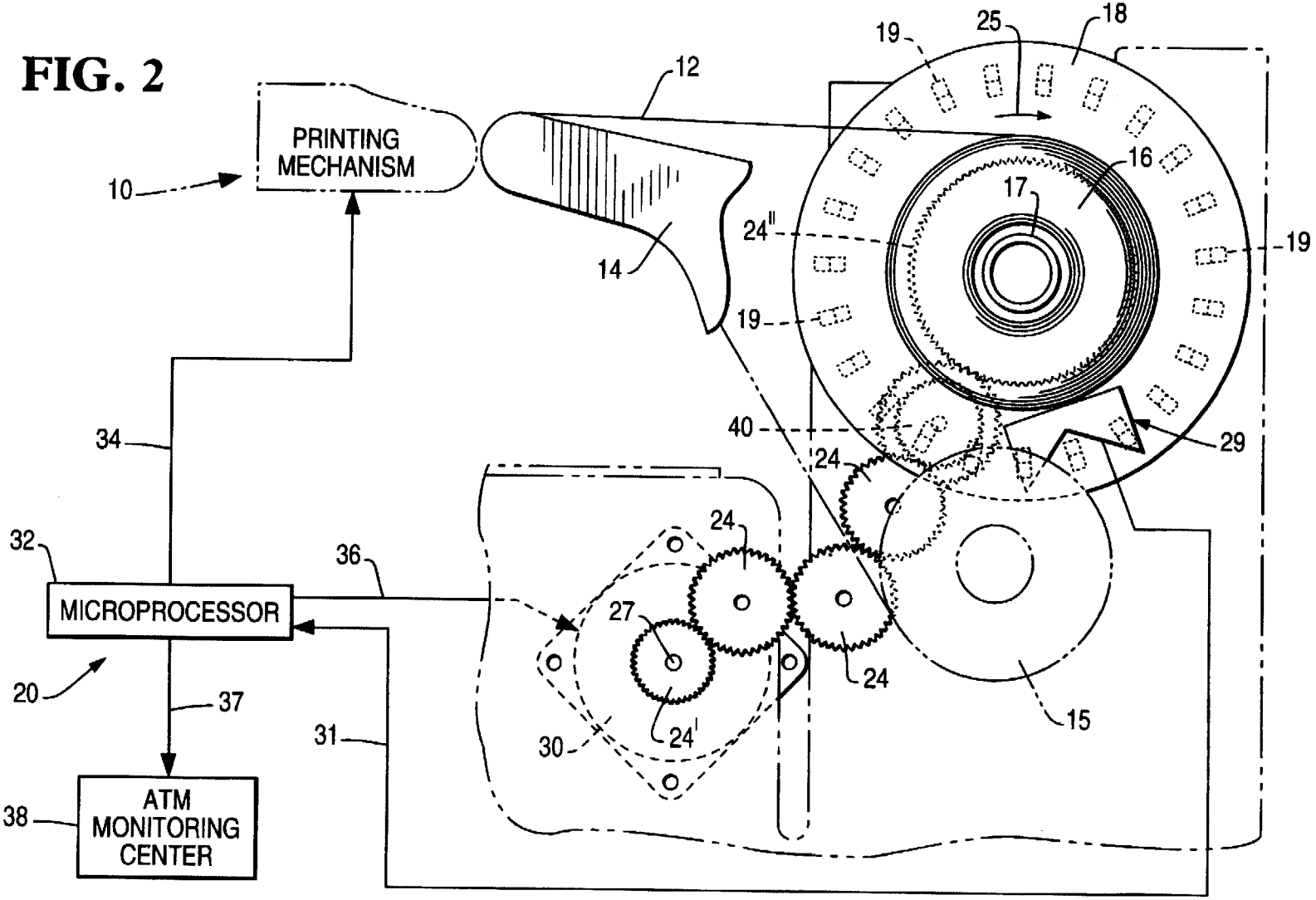
FIG. 2 depicts a partial, side, schematic view of the journal-printing mechanism and security system associated with this invention.

Now referring to FIGS. 1 and 2, respectively, a partial, perspective view and a partial, side, schematic view of the printing mechanism 10 and the security system 20 of this invention are shown. The printing mechanism 10 comprises a print head (not shown) that is in contact with a web of medium (paper) 12 that is fed over a platen 14.

The web of printing medium (paper) 12 is supplied from a supply roll 15. It is fed from the supply roll 15 to the platen 14, where the transaction is printed upon the paper 12 by the printing mechanism 10. The paper is then passed to and stored upon the take-up roll 16. A timing wheel 18, having a plurality of spaced-apart reflective surfaces 19 disposed intermittently about its periphery, is rotationally affixed to the shaft 17 supporting the take-up roll 16. The take-up roll 16 rotates with the shaft 17 due to the collar 21 disposed thereupon. This collar 21 engages frictionally with the internal core 22 of the take-up roll 16.

The take-up roll 16 is caused to rotate (arrow 25) by the journal drive motor 30 that drives a set of reduction gears 24 and slip clutch 40. Slip clutch 40 allows the journal drive motor 30 to supply sufficient tension to take-up roll 16 as paper 12 advances. When paper 12 is not advancing, slip clutch 40 prevents motor 30 from stalling by decoupling the last reduction gear 24" from reduction gears 24. The last reduction gear 24" of the set of reduction gears 24 is affixed to shaft 17, and the first reduction gear 24' is affixed to shaft 27 of motor 30.

A sensor 29 mounted upon the printing mechanism housing (not shown) senses when the reflective surfaces 19 of the rotating timing wheel 18 move past. The sensor 29 detects the transitions as each reflective surface moves past, generating high/low transition signals that are fed via schematic line 31 to microprocessor 32. While a reflective sensing technology has been chosen purposes of disclosure, any other sensing strategy such as see-through (interruptive), ultrasonic, mechanical, or magnetic (e.g. hall effect) capable of generating high/low transition signals responsive to the rotation of timing wheel 18 could with suitable modification to timing wheel 18, be employed. The microprocessor 32 counts the number of transitions generated by sensor 29, and thus determines the amount of paper being stored upon the take-up roll 16.

The microprocessor 32 feeds transaction data to the printing mechanism 10 via schematic line 34. The transaction is printed upon the moving paper web 12 by the printing mechanism 10 at the same time that the microprocessor commands the motor 30 to rotatively drive the take-up roll 16 via schematic line 36 and reduction gear set 24.

The microprocessor 32 provides a signal to a monitoring center 38 via line 37. When a jam has occurred in the printing system, the microprocessor 32 does not see the proper number of high-to-low transitions from sensor 29 via line 31, for the given amount of journal motor rotation that is controlled by the microprocessor via line 36. The microprocessor 32 continually monitors the signals from sensor 29. Any transition signals received by the microprocessor 32 from the sensor 29 will indicate tampering with the take-up roll 16, when the journal motor 30 is not running. The microprocessor 32 will then alert the monitoring center 38 when tampering is evident.

Figure 3:
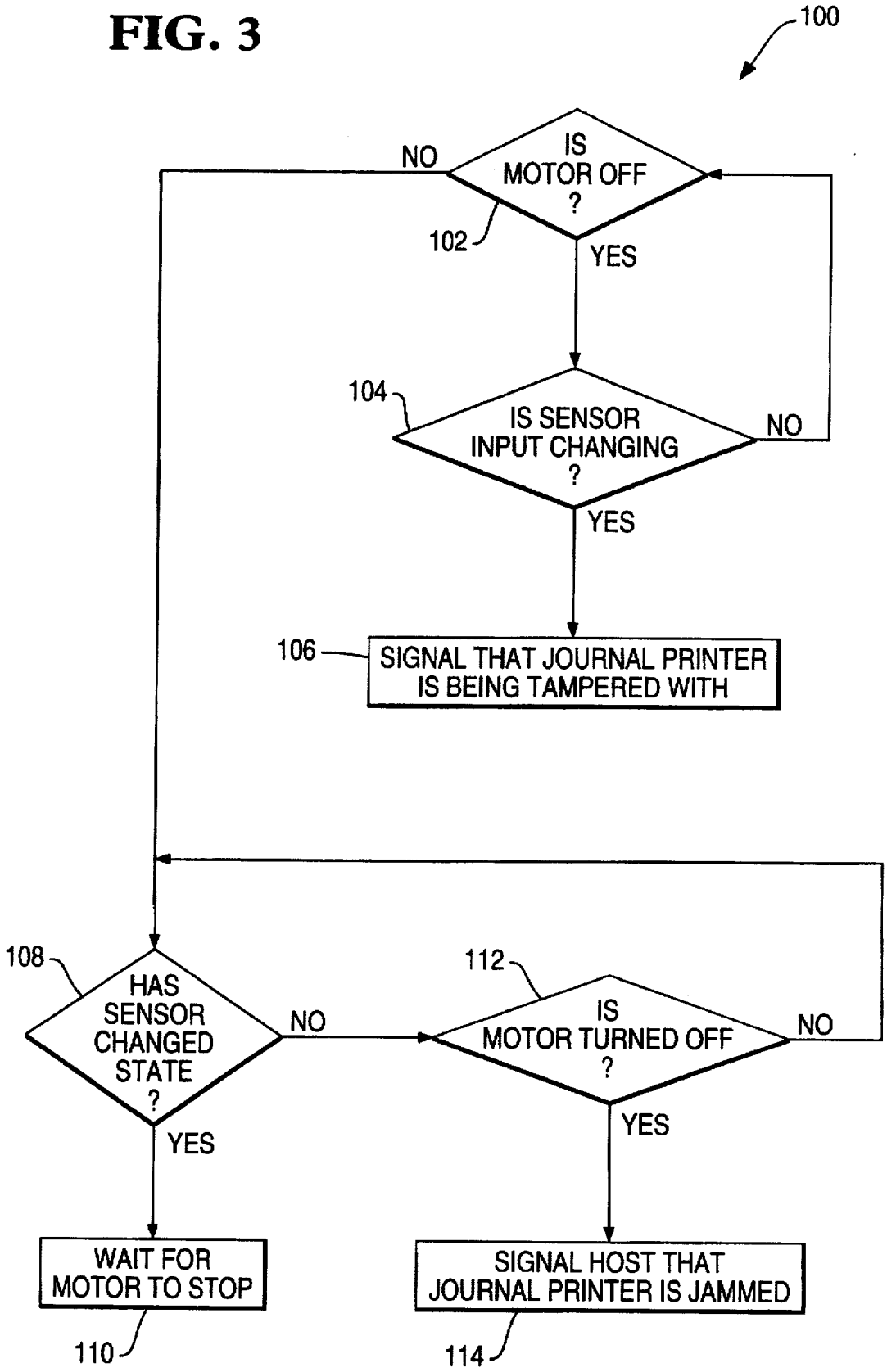
FIG. 3 shows a flowchart diagram of the method used by the security system illustrated in FIGS. 1 and 2.

Referring now to FIG. 3, a flowchart diagram 100 of the program executed by the microprocessor 32 is illustrated. The microprocessor (system) 32 interrogates the motor 30 to determine whether the motor is running, step 102. If the motor is off, the system determines whether the sensor input is changing, step 104; that is, are high/low transition signals being received by the system? If such transition signals are not being received, program execution loops to decision block 102. If, however, high/low transition signals are being received, step 104, a signal is generated and sent to the system indicating that the journal printer is being tampered with, step 106.

If the system determines that the motor is running, step 102, it then determines whether the sensor has changed state a predetermined number of times since the motor has been energized, step 108. If that is the case, the system waits for the motor to cease operating, step 110. If, however, the sensor has not changed state a predetermined number of times, step 108, the system then determines whether the motor has been turned off. If it has, a signal is generated and sent to the system that the journal printer is jammed or is malfunctioning, step 114. However, if the motor has not been turned off, step 112, the system again interrogates the sensor to determine whether it has changed state a predetermined number of times, step 108. The sensor/motor interrogation, steps 108 and 112, continues to occur until the motor is turned off, step 114, or the sensor has sufficiently changed state, step 110.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A security system for an unattended printing mechanism, comprising:

means defining a printing path between a supply roll supporting a roll of printing media and a rotationally-supported take-up roll for storing said printing media which contains transaction data;

a timing wheel rotationally affixed to the take-up roll and rotationally movable therewith;

a sensor disposed adjacent said timing wheel for sensing timing wheel rotation and, hence, rotation of said take-up roll, and, in response thereto, generating a plurality of signals indicative of said take-up roll rotation; a drive motor operatively connected to said take-up roll for rotationally driving said take-up roll; and a programmable microprocessor having a security program for sensing printing mechanism operation, said programmable microprocessor being operatively connected to said sensor and said drive motor, said microprocessor determining that a jam has occurred in the printing mechanism when it does not see a proper number of signals from said sensor for a given amount of drive motor rotations, and determining a tampering condition when signals are received by said microprocessor from said sensor when said drive motor is not driving said take-up roll.

2. The security system of claim 1, further comprising means connected to said programmable microprocessor for alerting a monitoring center for said unattended printing mechanism, when tampering or a jam is detected by said programmable microprocessor.

3. The security system of claim 1, further comprising a printing platen disposed in said printing path between said supply roll and said take-up roll.

4. The security system of claim 1, further comprising a set of reduction gears disposed between said drive motor and said take-up roll.

5. The security system of claim 4, wherein said set of reduction gears further comprises a slip clutch.

6. The security system of claim 1, wherein said timing wheel comprises a plurality of spaced-apart reflective surfaces intermittently disposed upon a peripheral edge thereof, and further wherein said sensor generates a plurality of high/low transition signals, depending upon movement of said reflective surfaces past said sensor.

7. The security system of claim 3, further comprising a printing mechanism disposed adjacent said printing platen and operatively connected to said programmable microprocessor for receiving transaction data therefrom.

8. A security system for an automatic teller machine, comprising:

means defining a printing path between a supply roll supporting a roll of printing media and a rotationally supported take-up roll;

a timing wheel rotationally affixed to the take-up roll and rotationally movable therewith;

a sensor disposed adjacent said timing wheel for sensing timing wheel rotation and, hence, rotation of said take-up roll, and, in response thereto, generating a plurality of signals indicative of said take-up roll rotation;

a drive motor operatively connected to said take-up roll for rotationally driving said take-up roll; and a programmable microprocessor having a security program for sensing printing mechanism operation, said programmable microprocessor being operatively connected to said sensor and said drive motor, said microprocessor determining that a jam has occurred in the printing mechanism when it does not see a proper number of signals from said sensor during drive motor operation, and determining that tampering has occurred when signals are received by said programmable microprocessor from said sensor when said drive motor is not driving said take-up roll.

9. The security system of claim 8, further comprising means connected to said programmable microprocessor for alerting an automatic teller machine monitoring center when tampering or a jam is detected by said programmable microprocessor.

10. The security system of claim 8, further comprising a printing platen disposed in said printing path between said supply roll and said take-up roll.

11. The security system of claim 8, further comprising a set of reduction gears disposed between said drive motor and said take-up roll.

12. The security system of claim 8, wherein said timing wheel comprises a plurality of spaced-apart reflective surfaces intermittently disposed upon a peripheral edge thereof, and further wherein said sensor generates a plurality of high/low transition signals, depending upon movement of said reflective surfaces past said sensor.

13. The security system of claim 10, further comprising a printing mechanism disposed adjacent said printing platen and operatively connected to said programmable microprocessor for receiving transaction data therefrom.

14. A security system for an unattended printing mechanism, comprising:

a rotationally supported take-up roll for storing printing media containing transaction data;

a timing wheel rotationally affixed to the take-up roll and rotationally movable therewith;

a sensor disposed adjacent said timing wheel for sensing timing wheel rotation and, hence, rotation of said take-up roll, and, in response thereto, generating a plurality of signals indicative of said take-up roll rotation;

a drive motor operatively connected to said take-up roll for rotationally driving said take-up roll; and a programmable microprocessor having a security program for sensing printing mechanism operation, said programmable microprocessor being operatively connected to said sensor and said drive motor, said microprocessor determining that a jam has occurred in the printing mechanism when it does not see a proper number of signals from said sensor for a given amount of drive motor rotations, and determining a tampering condition when signals are received by said microprocessor from said sensor when said drive motor is not driving said take-up roll.

15. The security system of claim 14, further comprising means connected to said programmable microprocessor for alerting a monitoring center for said unattended printing mechanism, when tampering or a jam is detected by said programmable microprocessor.

16. The security system of claim 14, further comprising a supply roll of printing media disposed adjacent said take-up roll, add a printing platen disposed in said printing path between said supply roll and said take-up roll.

17. The security system of claim 14, further comprising a set of reduction gears disposed between said drive motor and said take-up roll.

18. The security system of claim 17, wherein said set of reduction gears further comprises a slip clutch.

19. The security system of claim 14, wherein said timing wheel comprises a plurality of spaced-apart reflective surfaces intermittently disposed upon a peripheral edge thereof, and further wherein said sensor generates a plurality of high/low transition signals, depending upon movement of said reflective surfaces past said sensor.

20. The security system of claim 16, further comprising a printing mechanism disposed adjacent said printing platen and operatively connected to said programmable microprocessor for receiving transaction data therefrom.

* * * * *

UNITED STATES PATENT AND TRADEMARK OFFICE

CERTIFICATE OF CORRECTION

PATENT NO. : 5,685,655

DATED : Nov. 11, 1997

INVENTOR(S) : James R. DelSignore, II et al.

It is certified that error appears in the above-indentified patent and that said Letters Patent is hereby corrected as shown below:

Column 6, line 36, after "roll" delete "add" and insert --and--.

Signed and Sealed this

Twentieth Day of October, 1998

*Attest:*

Bruce Lehman

BRUCE LEHMAN

*Attesting Officer*

*Commissioner of Patents and Trademarks*